United States Patent [19]

Finkl et al.

[11] Patent Number: 5,059,389

[45] Date of Patent: Oct. 22, 1991

[54] LOW ALLOY STEEL PRODUCT

[75] Inventors: Charles W. Finkl, Evanston, Ill.; Albert L. Lehman, Boca Raton, Fla.

[73] Assignee: A. Finkl & Sons Co., Chicago, Ill.

[21] Appl. No.: 510,496

[22] Filed: Apr. 18, 1990

[51] Int. Cl.[5] ..... C22C 38/06

[52] U.S. Cl. ..... 420/67; 420/71; 420/91; 420/109

[58] Field of Search ..... 420/71, 91, 109, 67

[56] References Cited

U.S. PATENT DOCUMENTS

| | | | |
|---|---|---|---|
| 3,929,423 | 12/1975 | Finkl | 420/109 |
| 4,210,444 | 7/1980 | Bellot | 420/84 |
| 4,318,739 | 3/1982 | Lehman | 420/109 |
| 4,431,445 | 2/1984 | Furusawa et al. | 420/84 |
| 4,468,249 | 8/1984 | Lehman | 420/109 |
| 4,842,816 | 6/1989 | Miyasaka et al. | 420/84 |
| 4,915,900 | 4/1990 | Nomura et al. | 420/84 |

FOREIGN PATENT DOCUMENTS

| | | | |
|---|---|---|---|
| 0298685 | 3/1971 | U.S.S.R. | 420/109 |
| 2125822 | 3/1984 | United Kingdom | 420/109 |

*Primary Examiner*—Upendra Roy
*Attorney, Agent, or Firm*—James G. Staples

[57] ABSTRACT

A steel product, such as a medium carbon die block, having good impact, ductility, transverse and physical properties, and lower than normal sulphur contents yet having machinability equal or better than higher sulphur levels characterized by a lower than ordinary level of stringer-type inclusions, other inclusions being mainly of the non-deleterious globular type.

9 Claims, 3 Drawing Sheets

LOW ALLOY STEEL PRODUCT

This invention relates generally to low alloy hot work forging steel die blocks having advantageous properties over current commercial products including equal, and in some instances better, machinability with lower sulphur contents than are presently thought necessary, enhanced impact values and ductility attributable to phosphorus, but at lower levels of phosphorus while not affecting machinability, and increased transverse properties and Charpy values, even in the presence of higher than normal aluminum contents. All of the above attributes are obtained together with improved die wear and better pouring characteristics during the steel making process, particularly the elimination of shankering, which makes possible cleaner steel, and the elimination of nozzle blockage.

BACKGROUND OF THE INVENTION

In order to remain competitive with increased competition from casting and the tendency to design away from forged parts due to costs, today's die block maker must offer die block quality equal to current quality at lower cost, or a better quality at equal or lower cost, in order to reduce the unit cost of parts produced. An average production run increase of only a few percent or a few thousand pieces will impact heavily on the unit cost. The typical rugged operating conditions to which products of this invention are subjected are well described in U.S. Pat. No. 3,929,423, the subject matter of which this invention constitutes an improvement upon. As there described, die blocks of the type to which this invention is directed are subjected to unusually severe operating conditions during normal use since, among other things, they are subjected to intermittent heating and cooling from temperatures of, for example, about 300° F. to about 1100° F. and more, heavy impact loads and severe abrasion. Under abnormal working conditions, which invariably occur from time to time in any operation, the die blocks may be subjected to prolonged exposure at high temperatures as where a high temperature workpiece becomes stuck in the dies, or where a large forging is not lifted from the lower cavity between blows. Concurrently with the aforesaid operating conditions the die blocks must be relatively easily machinable, mainly after final heat treatment.

SUMMARY OF THE INVENTION

A primary object of this invention is to provide a die block having high impact values and good ductility, cleaner and stronger physical properties, improved transverse properties, including Charpy values, better processing characteristics, and equal or better machinability with lower than normal sulphur levels.

Another object is to provide a die block having the following broad composition by weight percent:

| | |
|---|---|
| C | .45–.60 |
| S | .025 max |
| P | .018 max |
| Si | .35 max |
| Mn | .65–1.25 |
| Cr | .60–1.75 |
| Ni | .75–1.25 or |
| Cu | up to .50 in the ratio of 2 Cu/Ni over .25 Cu, excess Ni |
| Mo | .30–.45 |
| V | .03–.10 |

-continued

| | |
|---|---|
| Al | .025 max in the presence of |
| Ca | approx. 15% of Al. |

More preferably it is an object of this invention to provide a die block having the following preferred composition by weight percent:

| | |
|---|---|
| C | .45–.60 |
| S | .022 max |
| P | .010–.018 |
| Si | .35 max |
| Mn | .65–1.25 |
| Cr | .75–1.40 |
| Ni | .85–1.15 or |
| Cu | up to .50 in the ratio of 2 Cu/Ni over .25 Cu, excess Ni |
| Mo | .33–.43 |
| V | .04–.06 |
| Al | .15–.020 in the presence of |
| Ca | approx. 15% of Al |

Another object is to provide a die block having the following most preferred composition by weight percent:

| | |
|---|---|
| C | .45–.60 |
| S | .020 aim |
| P | .012 aim |
| Si | .35 max |
| Mn | .65–1.25 |
| Cr | .85–1.15 |
| Ni | .85–1.15 or |
| Cu | up to .50 in the ratio of 2 Cu/Ni over .25 Cu, excess Ni |
| Mo | .36–.43 |
| V | .05 aim |
| Al | .15 aim |
| Ca | approx. 15% Al |

Other objects and advantages will be apparent from the following description.

BRIEF DESCRIPTION OF THE DRAWING

The understanding of the invention will be facilitated by the accompanying drawing wherein.

DESCRIPTION OF THE INVENTION

Figure 1:
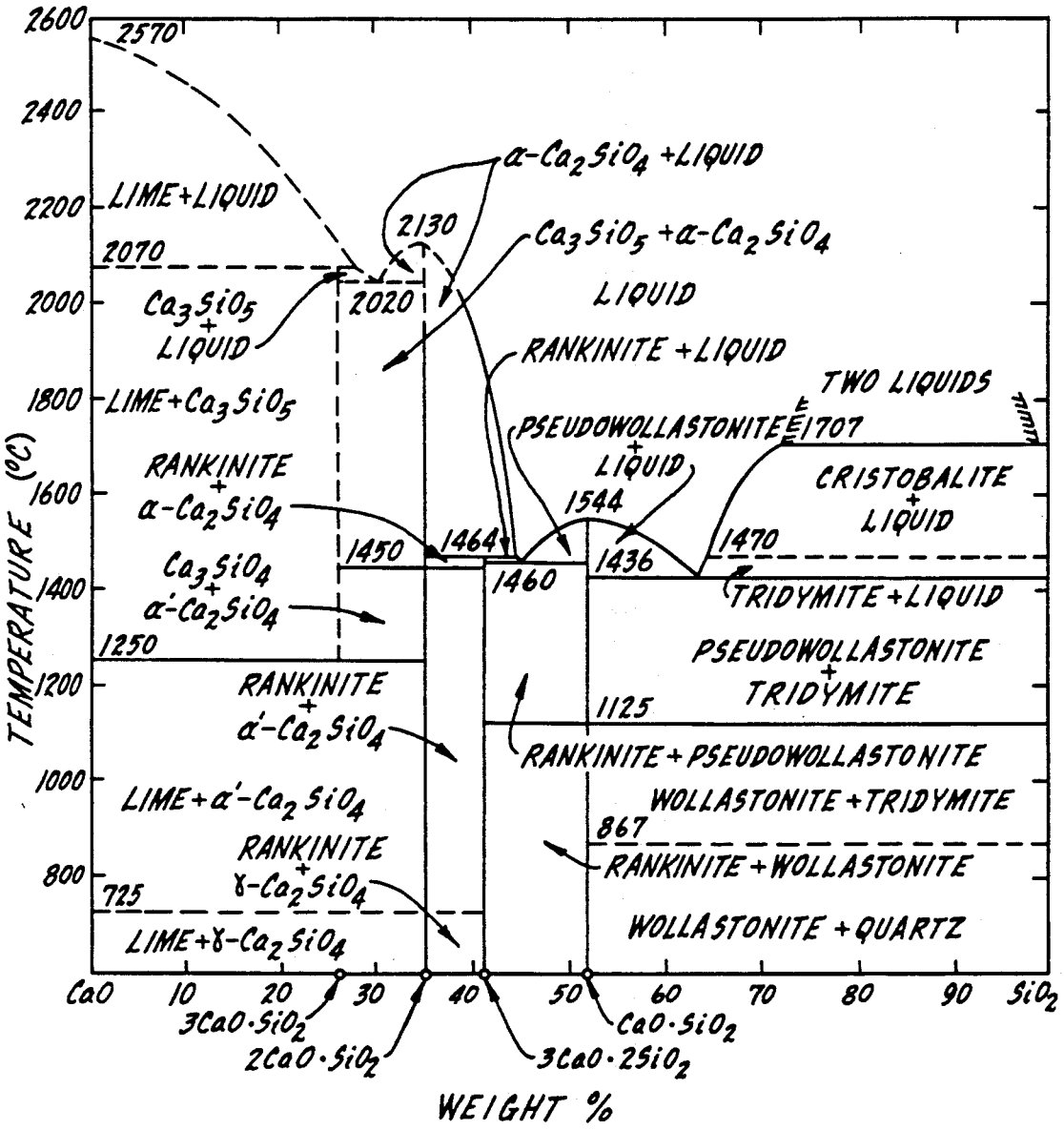
FIG. 1 is a phase diagram for the system $CaO\text{-}SiO_2$.

Carbon is necessary to provide the required wear resistance and hardness. If the carbon is significantly higher than 0.60 the die blocks will be subject to breakage in the field. If substantially less than 0.45 carbon is used wear resistance will not be suitable for the extremely strenuous field applications to which the die blocks are subjected. Preferably a minimum of 0.50 carbon is used to ensure good wear resistance and hardness, and maximum production. Most preferably carbon in the range of 0.53 to 0.57 with an aim of 0.55 is used.

Sulphur is essential for machinability and it is commonly believed the sulphur must be present in amounts up to 0.045 in this type of steel in order to attain acceptable machinability. Sulphur does however have several well known deleterious effects in this type of steel, including an increasing tendency toward hot shortness with an increase in sulphur content. It is desirable therefore to use the least quantity of sulphur which will provide the required level of machinability. In the instant invention, sulphur in an amount substantially greater than 0.025 may tend to produce excess sulphidies which will deleteriously effect transverse properties. If significantly less than about 0.010 sulphur is present, even under the conditions described herein, the required machinability may not be attained. A more preferred range is up to 0.022 max and excellent results have been attained at an aim of 0.015.

Since these unusually low sulphur values are related to the presence and quantities of aluminum and calcium, the quantity and treatment of aluminum and calcium are next described.

Aluminum is desirable for grain refinement and, in low quantities, for fluidization of the molten steel. Since the amount of aluminum present has been considered to have a significant effect on the quality of aluminates, and aluminates have universally been considered a contaminant, it has heretofore been thought essential to minimize the amount of aluminum present (As those skilled in the art appreciate, there are essentially four types of non-metallic inclusions which, in this type of steel, are considered impurities, namely silicates, aluminates, complex oxides, and sulphides.)

The quantity of silicates and aluminates formed are somewhat proportional to the amount of available oxygen in the steel. The complex oxides are thought to be formed largely during tapping and teeming. The amount of sulphides formed will, of course, be proportional to the sulphur or sulphur containing materials in the steel, including sulphur from such sources as scrap and oil in turnings and other scrap materials in the shop, the degree to which furnace or vacuum ladle refining is carried out, and intentional additions such as ladle additions of pyrites to meet the desired sulphur specification. Teeming techniques to reduce oxygen pick up may be employed such as the use of a vacuum or inert atmosphere during teeming and/or elimination of splash through the use of splash pads, no dribble teeming techniques or bottom pouring.

The silicates and aluminates are formed as the oxygen comes out of solution due to temperature drop. It is believed that if, at the time the silicates and aluminates are formed, a condition of oxygen starvation in the molten steel exists the oxide and sulphide formation can be very significantly decreased. Accordingly it is essential that steps be taken to ensure low oxygen levels in the steel. It has now been confirmed that if a ratio of about 15 percent calcium to aluminum is maintained, the stringer non-metallic inclusions such as $Al_2O_3$ and $SiO_2$ are converted to round globular complex oxides which are finely dispersered throughout the steel. Sulphur is also globularized. As a result the stringer type inclusions which act as stress risers are significantly reduced resulting in better JK ratings, and cleaner and stronger steel.

The attainment of low silicate and aluminate contents in the steel of this invention, as contrasted to chemically similar steels, is specifically believed to be attributable to careful control of the "V" ratio during processing, also known as the lime-silica ratio; i.e., lime/silica. In practice however it has been found that the V ratio is more realistically $(Ca+MgO)/(SiO_2+Al_2O_3)$. Specifically, this ratio should equal about 2.25/1.0.

Figure 2:
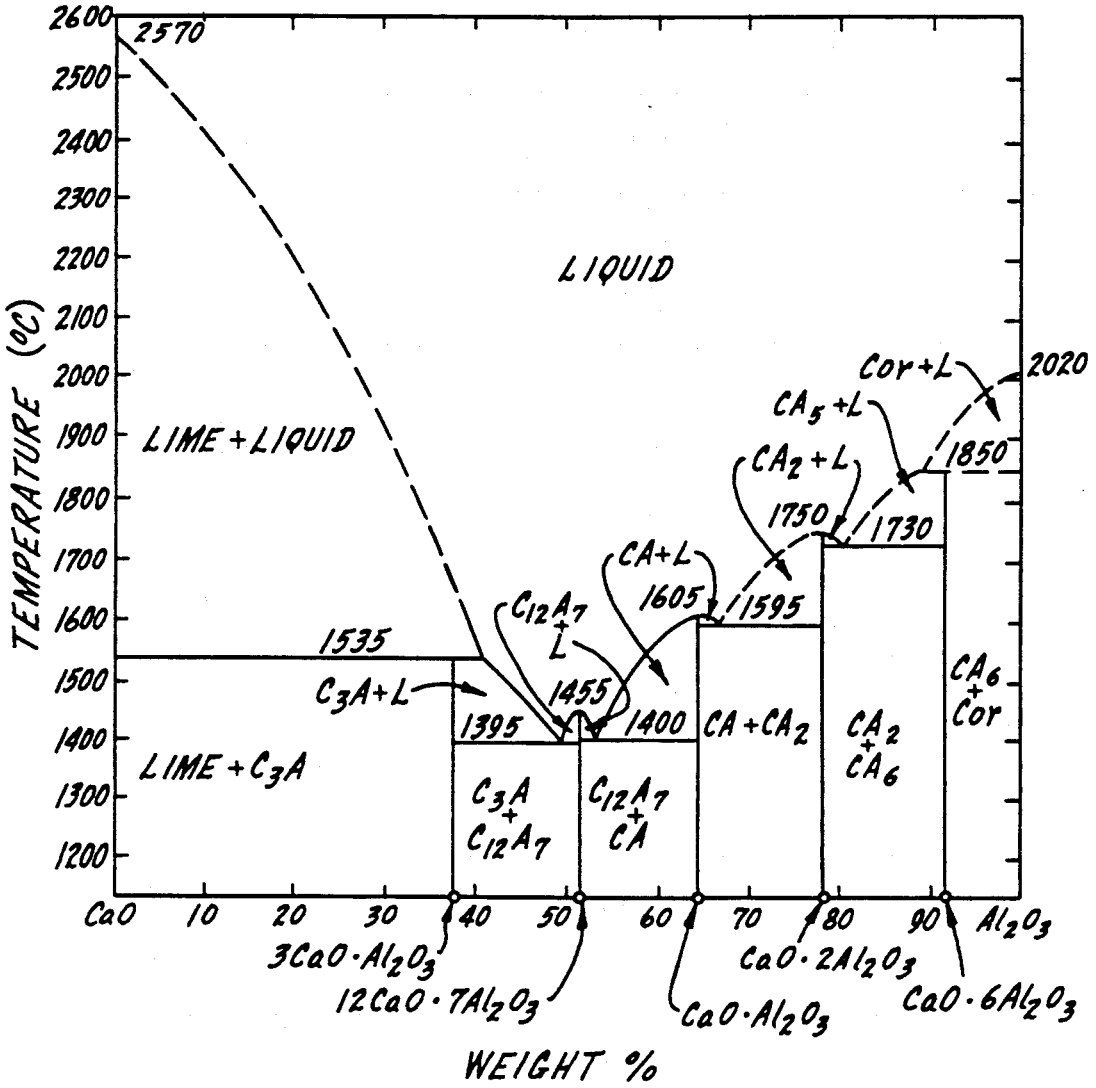
FIG. 2 is a phase diagram for the system $CaO\text{-}Al_2O_3$.

This desirable ratio can be seen from a study of FIG. 1, which is the phase diagram for the system $CaO\text{-}SiO_2$ based mainly on the work of Day, Shepherd, and Wright, and others with revisions based on more recent data, and of FIG. 2, which is the phase diagram for the system $CaO\text{-}Al_2O_3$ based mainly on the original work of Rankin and Wright and modified with more recent data of others. Both phase diagrams are found in "Phase Equilibria Among Oxides in Steelmaking", Muan et al, Addison-Wesley Publishing Company, Inc., Reading, Mass.,pages 36 and 43 respectively.

In the lime-silica phase diagram of FIG. 1 it will be noted that a liquidous trough occurs just below the tricalcium silicate level, and more specifically in the ratio of about 45% to 65% $SiO_2$ as shown at the foot of the diagram. In the lime-alumina phase diagram of FIG. 2 it will be noted that a trough appears at 50% alumina, which is the eutectic. From the foregoing it will be noted that with a V ratio of about 2.25:1 to about 2:1 a low melting point slag is approached, with the result that the non-metallics go into solution so they can be floated out of the steel.

It will also be noted that a V ratio of less than about 2 results in a steep increase in the liquidous temperature to the point where it exceeds the melting temperature of the steel. The result in such a case is that these slag inclusions remain solid, can be trapped in the steel, and hence make dirty steel.

Figure 3:
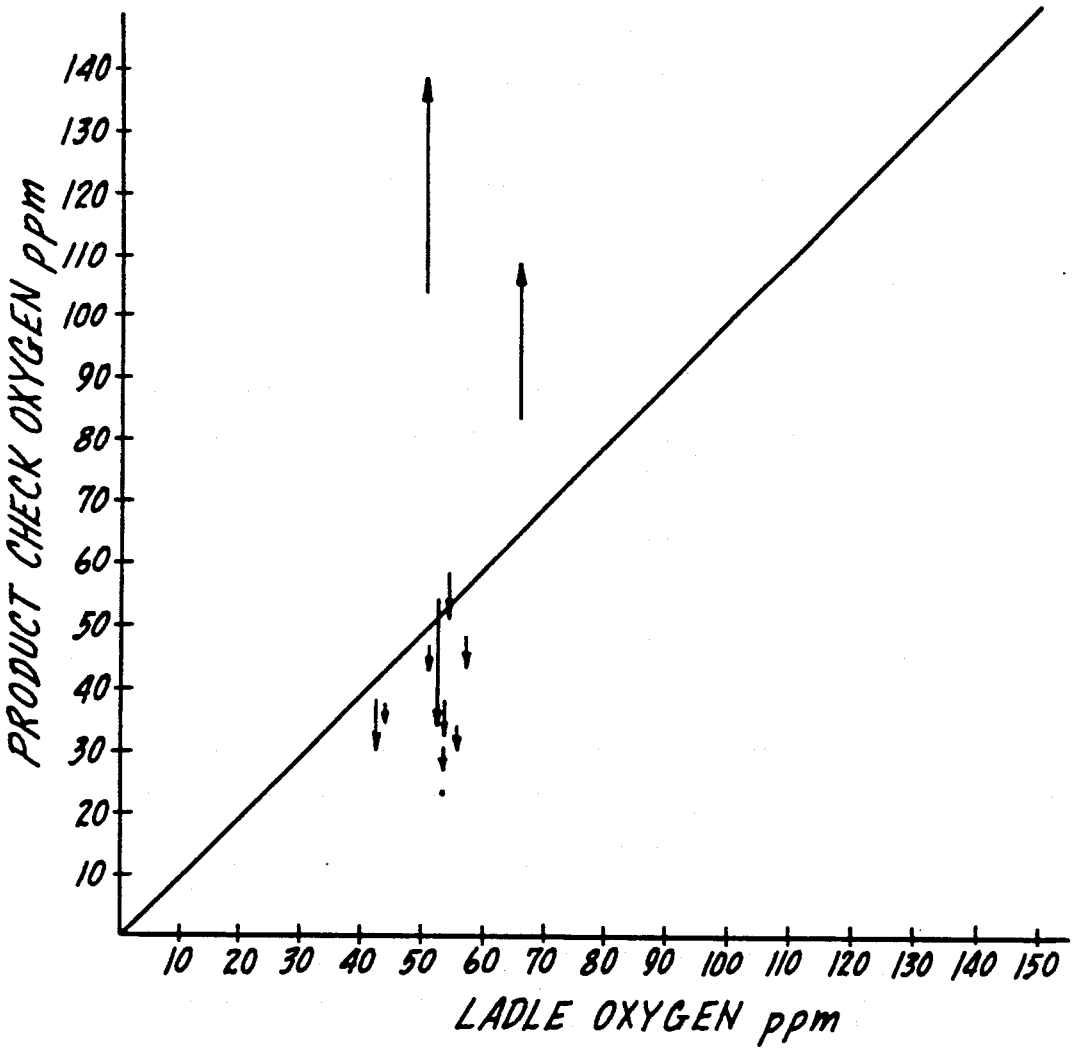
FIG. 3 is a chart comparing (i) the after vacuum and solid product oxygen contents in a first group of heats which were not subjected to the processing set out herein, to (ii) the after vacuum and solid product oxygen contents in a second group of heats which were subjected to the processing set out herein.

A further indication of the efficacy of the process disclosed herein is illustrated in FIG. 3 which compares total oxygen content measured after vacuum processing against total oxygen content in the solid steel. Normally the total oxygen content increases during teeming so that the final content is higher than the after vacuum treatment content. However, by use of the herein described calcium to aluminum ratio in the processing, it was noted that the total oxygen content decreased, rather than increased, as would be expected. Specifically, the first heat in the upper section of the chart, which was not processed according to the invention, shows an increase in oxygen content from 104 ppm after vacuum up to 138 ppm in the final product, or an increase of about 35%. However, the first heat in the lower section of the chart, which was processed according to the invention, shows a decrease in oxygen content from 38 ppm down to 31 ppm which, as to that particular heat, was a decrease of approximately 19%. All heats were of low alloy steel processed in the same melt shop under conditions which would not result in a variance in results beyond the difference in processing discussed herein.

With the deleterious effect of inclusions attributable to aluminum reduced or virtually eliminated by balancing the aluminum and calcium contents, higher aluminum contents are possible, thus providing the steel maker the ability to pour the steel without shankering or nozzle breakage which would have resulted from the relatively high levels of aluminum present in the steel of this invention without the modifying presence of the above-mentioned ratio of calcium to aluminum. Improved transverse properties of several times greater than standard steels, primarily reduction of area transverse, have been observed, as well as improved Charpy results.

Phosphorus can exert a beneficial effect on machinability. However, the deleterious effects of phosphorus in this general type of steel, such as an increase in the transition temperature, outweigh any beneficial effects and accordingly the phosphorus content should be kept as low as possible. Under no circumstances should it more than 0.018%, and most preferably no more than 0.012%. It has been observed that greatly enhanced impact values and ductility have resulted. These factors translate into reduced die breakage with advantageous results to both the user of the steel and the die block manufacturer who stands behind his product.

Silicon is specified for its deoxidizing ability in the steelmaking process. If silicon is present in substantially greater quantities than that specified there is a tendency towards embrittlement of the final product. If the die blocks are made by conventional steelmaking processes the silicon may be in the range of 0.20 to 0.35. However if the molten steel from which the die blocks are made is subjected to carbon deoxidation treatment, silicon levels at the lower end of the range may be quite acceptable.

Manganese is necessary for hardenability and as a deoxidizer in the steelmaking process. It also functions to control sulphides in forging operations. If significantly more than 1.25% manganese is present there is a danger that retained austenite will be present. If substantially less than 0.65% manganese is present the hardenability of the die block may be deleteriously affected. In addition manganese contributes to wear resistance, although to a lesser extent than other carbide formers. Preferably manganese is present in the range of 0.75% to 1.10%, and most preferably from 0.75% to 0.95%. Manganese should be present in an amount at least 20 times the sulphur content to ensure sulphur control.

Chromium is necessary for carbide formation, for hardenability, and for wear resistance. If substantially more than the maximum specified amount of 1.75 chromium is present the hardening temperature will be too high for normal production heat treatment, and heavy sections will be subject to loose or weak centers. If substantially less than the minimum specified quantity of 0.60 chromium is present the die block will be deficient in wear resistance and hardenability. Preferably chromium is present in the amount of 0.75% to 1.40%, and most preferably from 0.85% to 1.15%.

Molybdenum is one of the most important elements. It is a potent carbide former and contributes to hardenability and wear resistance. Preferably the molybdenum is maintained between 0.33 to 0.43 since this range appears to yield optimum results, although a range of 0.30 to 0.45 may be tolerable. For thick sections it may be desirable to work near the upper end of the broad range, and preferably in the range of 0.36 to 0.43. If the final product is to be a die block of substantial cross-sectional thickness it may be advantageous to increase the molybdenum to a minimum of 0.36 to ensure thorough response to the hardening process.

Vanadium is specified for its grain refining properties. If a significantly greater quantity of vanadium is present than that specified the hardenability of the die block may be decreased due to the insolubility of vanadium carbide at normal heat treat temperatures. If significantly less vanadium is present than that specified the necessary grain refinement may not be achieved. Preferably vanadium is present in the range of 0.03 to 0.10, and most preferably in the range of 0.04 to 0.06, with an aim of 0.05.

Nickel is required to impart toughness to the die block and strengthen the ferrite. If substantially more than 1.25% nickel is present there is a danger of retained austenite and decreased machinability. Excess nickel may also promote hairline cracking which requires scarfing and/or conditioning at the press. If substantially less than 0.75% nickel is present than that specified, the die block will lack toughness, and hardenability will be reduced, thereby adversely affecting die life in large sections by washing. Preferably nickel should be present in the range of about 0.85–1.15%, and most preferably in the range of 0.85–1.05%.

It has been discovered that copper is substantially interchangeable with nickel up to about 0.5% for the die blocks with which this invention is concerned. Accordingly copper may be substituted for nickel up to about 0.5% copper. However, experience has shown that the nickel content should always be higher than the copper to avoid problems in forging the die blocks. Therefore, the nickel and copper content may be expressed as nickel and/or copper of from about 0.75% to about 1.75%, or other specified range, but not to exceed 0.50% cooper, with the nickel content always greater than the copper content, and preferably about twice as great.

In the manufacture of the die blocks of this invention by electric furnace practice it is desirable to make maximum use of melting scrap of similar composition. Conventional electric furnace processing steps may then be followed, except as noted below.

Phosphorus removal may be accomplished by utilization of mill scale at low temperatures, that is, in the range of about 2750° F. to 2840° F., for example. The mill scale formed during forging has the desirable ability to yield substantial quantities of oxygen to the bath while keeping the bath relatively cool. Slag-off of this initial oxidizing slag is preferably carried out at low temperatures, that is, under about 2840° F., to remove the $P_2O_3$ from the molten metal into the slag system.

After furnace processing the steel may be further deoxidized in the tapping ladle by tapping onto V, FeSi, and/or CaSi or other metallic deoxiders.

If the sulphur content is below specification at this point resulphurization to reach an aim of 0.022, for example, may be carried out by the addition of stick sulphur, pyrities, or other appropriate sulphur addition materials.

After furnace and tapping ladle treatment the tap ladle should be subjected to refining under vacuum conditions, preferably by subjection to the simultaneous effect of vacuum and purging as illustrated and described in greater detail in U.S. Pat. No. 3,236,635 to which reference is here made for a more detailed understanding. Such vacuum degassing treatment is carried out for a period of time which will enable the total oxygen level in the steel to be lowered to under 60 ppm, preferably under 50 ppm, and most preferably under about 30–35 ppm. In a heat of approximately 65 tons the vacuum degassing may for example be carried out for about 10 to 30 minutes, the exact time depending upon the usual process variables encountered in commercial melt shop practice including temperature, amount of slag present, and starting gas values.

The vacuum degassing treatment causes flotation of undesirable large non-metallic inclusions into whatever slag may be present on the surface. It will be understood that these inclusions are particularly deleterious in the final product since they adversely affect transverse properties and can function as focal points for stress raisers.

The vacuum degassing treatment further ensures reduction of hydrogen into the flake-free region. Experience has shown that for this type of steel the bulk of a large number of heats will be flake free at the 2.5 ppm level. However, since the failure attributable to flaking, usually termed "thermal rupture" is a serious defect it is desirable that the possibility of failure due to flaking be minimized as much as possible, and accordingly a maximum of 2.4 ppm is specified. Flaking failures have occurred even in the 2.3 to 2.4 ppm range and accordingly a maximum of 2.2 ppm is preferred. Recently rare cases of flaking have been experienced at the 2.2 ppm level and accordingly 2.0 ppm maximum is the most preferred limit.

To ensure that a thoroughly uniform and controllable teeming temperature of about 2830° F. in the ladle will be obtained at the conclusion of the vacuum degassing treatment, the steel may be subject to intermittent or continuous alternating current arc heating under vacuum, as more fully described in U.S. Pat. Nos. 3,501,289 and 3,501,290, to which reference is here made for a more detailed understanding.

Other processing steps such as inert gas shroud or vacuum teeming, and/or bottom pouring may be employed as necessary to ensure a sound ingot having good surface qualities.

The silicates and aluminates will be substantially randomly dispersed in such fashion as to minimize their deleterious effects on transverse properties. Further, there will be a reduction in the number of especially large sized inclusions in the center of the ingot and a decreased concentration of inclusions near the surface of the ingot.

From the foregoing description it will be appreciated that a unique die block having a low non-metallic inclusion content, particularly inclusions of silicates and aluminates, good machinability and improved processing characteristics, has been disclosed. Various modifications will of course at once occur to those skilled in the art. Accordingly, the scope of the invention should be limited not by the scope of the foregoing exemplary description, but only by the scope of the hereinafter appended claims when interpreted in light of the pertinent prior art.

I claim:

1. A steel product, said steel product being characterized by the presence of a substantial content of aluminum in combination with a low quantity of globularized non-metallic inclusions substantially encapsulated in Ca, excellent machinability in the presence of a low sulphur content, good hardenability and through hardness, said product consisting essentially of the following composition in weight percent:

| | |
|---|---|
| C | .45–.60 |
| S | .025 max |
| P | .018 max |
| Si | .35 max |
| Mn | .65–1.25 |
| Cr | .60–1.75 |
| Ni | .75–1.25 or |
| Cu | up to .50 in the ratio of 2 Cu/Ni over .25 Cu, excess Ni |
| Mo | .30–.45 |
| V | .03–.10 |
| Al | .025 max in the presence of |
| Ca | approx. 15% of Al. |

2. The steel product of claim 1 further characterized in that said composition further includes

| | |
|---|---|
| O | 60 ppm max. |
| H | 2.4 ppm max. |

3. The steel product of claim 1 further characterized in that said composition further includes

| | |
|---|---|
| O | 50 ppm max. |
| H | 2.2 ppm max. |

4. A steel product, said steel product being characterized by the presence of a substantial content of aluminum in combination with a low quantity of globularized non-metallic inclusions substantially encapsulated in Ca, excellent machinability in the presence of a low sulphur content, good hardenability and through hardness, said product consisting essentially of the following composition in weight percent:

| | |
|---|---|
| C | .45–.60 |
| S | .022 max |
| P | .10–.018 |
| Si | .35 max |
| Mn | .65–1.25 |
| Cr | .75–1.40 |
| Ni | .75–1.25 |
| Cu | up to .50 in the ratio of 2 Cu/Ni over .25 Cu, excess Ni |
| Mo | .33–.43 |
| V | .04–.06 |
| Al | .15–.020 in the presence of |
| Ca | approx. 15% of Al |

5. The steel product of claim 4 further characterized in that said composition further includes

| | |
|---|---|
| O | 60 ppm max. |
| H | 2.4 ppm max. |

6. The steel product of claim 4 further characterized in that said composition further includes

| | |
|---|---|
| O | 50 ppm max. |
| H | 2.2 ppm max. |

7. A steel product, said steel product being characterized by the presence of a substantial content of aluminum in combination with a low quantity of deleterious, non-metallic inclusions substantially encapsulated in Ca, excellent machinability in the presence of a low sulphur content, good hardenability and through hardness, said product consisting essentially of the following composition in weight percent:

| | |
|---|---|
| C | .45–.60 |
| S | .020 aim |
| P | .012 aim |
| Si | .35 max |
| Mn | .65–1.25 |
| Cr | .85–1.15 |

-continued

| | |
|---|---|
| Ni | .75–1.25 or |
| Cu | up to .50 in the ratio of 2 Cu/Ni over .25 Cu, excess Ni |
| Mo | .36–.43 |
| V | .05 aim |
| Al | .15 aim |
| Ca | approx. 15% Al. |

8. The steel product of claim 7 further characterized in that said composition further includes

| | |
|---|---|
| O | 60 ppm max. |
| H | 2.2 ppm max. |

9. The steel product of claim 7 further characterized in that said composition further includes

| | |
|---|---|
| O | 50 ppm max. |
| H | 2.2 ppm max. |

* * * * *